US011276337B1

(12) United States Patent
Yavruyan

(10) Patent No.: US 11,276,337 B1
(45) Date of Patent: Mar. 15, 2022

(54) SYSTEMS AND METHODS FOR AN INTELLIGENT SAFETY AND WARNING CONE

(71) Applicant: Chain Vault Inc., Burbank, CA (US)

(72) Inventor: Ara Yavruyan, Burbank, CA (US)

(73) Assignee: CHAIN VAULT INC., Burbank, CA (US)

( * ) Notice: Subject to any disclaimer, the term of this patent is extended or adjusted under 35 U.S.C. 154(b) by 0 days.

(21) Appl. No.: 17/105,431

(22) Filed: Nov. 25, 2020

(51) Int. Cl.
*G09F 27/00* (2006.01)
*G09F 15/00* (2006.01)
*E01F 13/02* (2006.01)

(52) U.S. Cl.
CPC ..... *G09F 27/005* (2013.01); *E01F 13/022* (2013.01); *E01F 13/024* (2013.01); *G09F 15/0056* (2013.01); *G09F 27/004* (2013.01); *G09F 2027/001* (2013.01)

(58) Field of Classification Search
CPC .. G09F 27/005; G09F 15/0056; G09F 27/004; G09F 2027/001
See application file for complete search history.

(56) References Cited

U.S. PATENT DOCUMENTS 5,208,940 A * 5/1993 London ..... A47L 7/0038 15/329
8,328,462 B2 * 12/2012 Beh ..... E01F 9/654 404/9
2003/0115783 A1 * 6/2003 Woosley ..... G09F 27/00 40/584
2007/0157485 A1 * 7/2007 Andrisin ..... F26B 21/001 34/201
2008/0271338 A1 * 11/2008 Muir ..... F26B 21/001 34/201
2015/0243144 A1 * 8/2015 Cantave ..... G08B 13/2491 340/541
2017/0088046 A1 * 3/2017 Denny ..... B61L 29/24
2018/0068536 A1 * 3/2018 Green, Jr. ..... G09F 27/00

* cited by examiner

*Primary Examiner* — Gary C Hoge
(74) *Attorney, Agent, or Firm* — Procopio, Cory, Hargreaves & Savitch LLP

(57) ABSTRACT

An intelligent cone comprises a base; a cone section; at least one light; a 360 degree motion sensing system; a fan; and at least one hardware processor; and one or more software modules that are configured to, when executed by the at least one hardware processor, receive information from the sensing system indicating that a person is approaching the intelligent cone, activate the at least one light as a warning to the approaching person, and operate the fan to dry a spill or moisture that is creating a safety issue.

14 Claims, 10 Drawing Sheets

Open API Integrations

SYSTEMS AND METHODS FOR AN INTELLIGENT SAFETY AND WARNING CONE

BACKGROUND

1. Technical Field

The embodiments described herein are related to an intelligent safety and warning cone, and more particularly to a safety and warning cone that can sense movement, issue warning, address spills and provide data related to an event.

2. Related Art

Safety and warning cones are ubiquitous and are used to signal danger. Safety and warning cones are placed around construction sites, are used to indicate areas to stay away from, areas that may be dangerous, etc. In grocery and other stores, safety and warning cones are used to indicate spills, wet floors, and other potential dangers. The problem with conventional safety and warning cones is that there is often no one present to ensure that people respect the warning.

In fact, the ubiquitousness of safety and warning cones may actually reduce their effectiveness. People are so used to seeing them that they start to become somewhat unnoticeable and people do not always heed the warning. For example, in a grocery store a cone may be placed to designate a wet floor. But the cone may still be present long after the floor is no longer wet. People see that the floor is not wet and realize there is no safety issue. As a result, people become somewhat desensitized to the presence of a safety and warning code.

SUMMARY

Systems and methods for an intelligent safety cone are described herein.

According to one aspect, an intelligent cone comprises a base; a cone section; at least one light; a 360 degree motion sensing system; a fan; and at least one hardware processor; and one or more software modules that are configured to, when executed by the at least one hardware processor, receive information from the sensing system indicating that a person is approaching the intelligent cone, activate the at least one light as a warning to the approaching person, and operate the fan to dry a spill or moisture that is creating a safety issue.

These and other features, aspects, and embodiments are described below in the section entitled "Detailed Description."

BRIEF DESCRIPTION OF THE DRAWINGS

Features, aspects, and embodiments are described in conjunction with the attached drawings, in which.

DETAILED DESCRIPTION

Figure 1C:
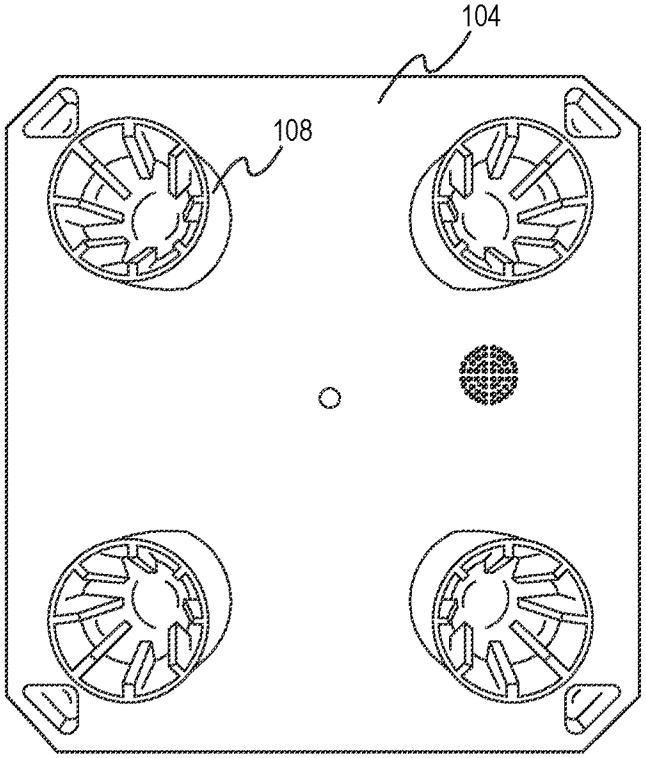
FIGS. 1A-C illustrate an intelligent cone in accordance with one example embodiment.
Figure 1B:
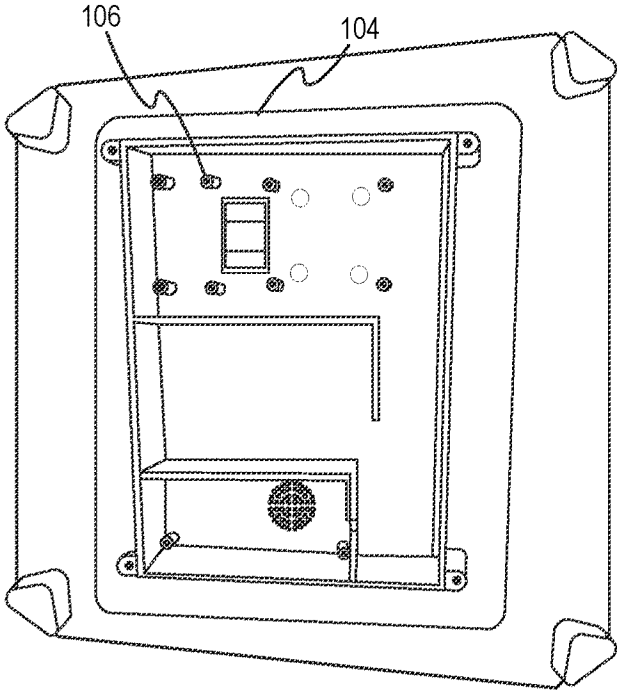
Figure 1A:
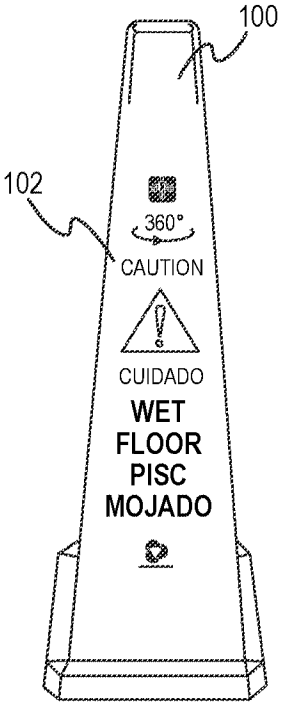

FIG. 1A illustrates an example embodiment of an intelligent safety cone 100 configured in accordance with one example embodiment. As can be seen, cone 100 can comprise a base 104 and a cone section 102. In this example, the cone section 102 comprises four distinct tapered sides, but in other examples cone section can be conical or comprise some other shape or geometry. In certain examples, base section 104 can comprise a flat bottom that rest on the ground. Alternatively, base section 104 can comprise legs 108 or some other type of lift mechanism to raise the base section 104 off the ground as illustrated in FIG. 1C. This can be beneficial for example, because base 104 may comprise electronics that operate intelligent cone 102.

For example, FIG. 1B illustrates the top of base 104 in accordance with one embodiment. As can be seen, base 104 can have one or more compartments 106 for housing electronics as described in more detail below.

Figure 2:
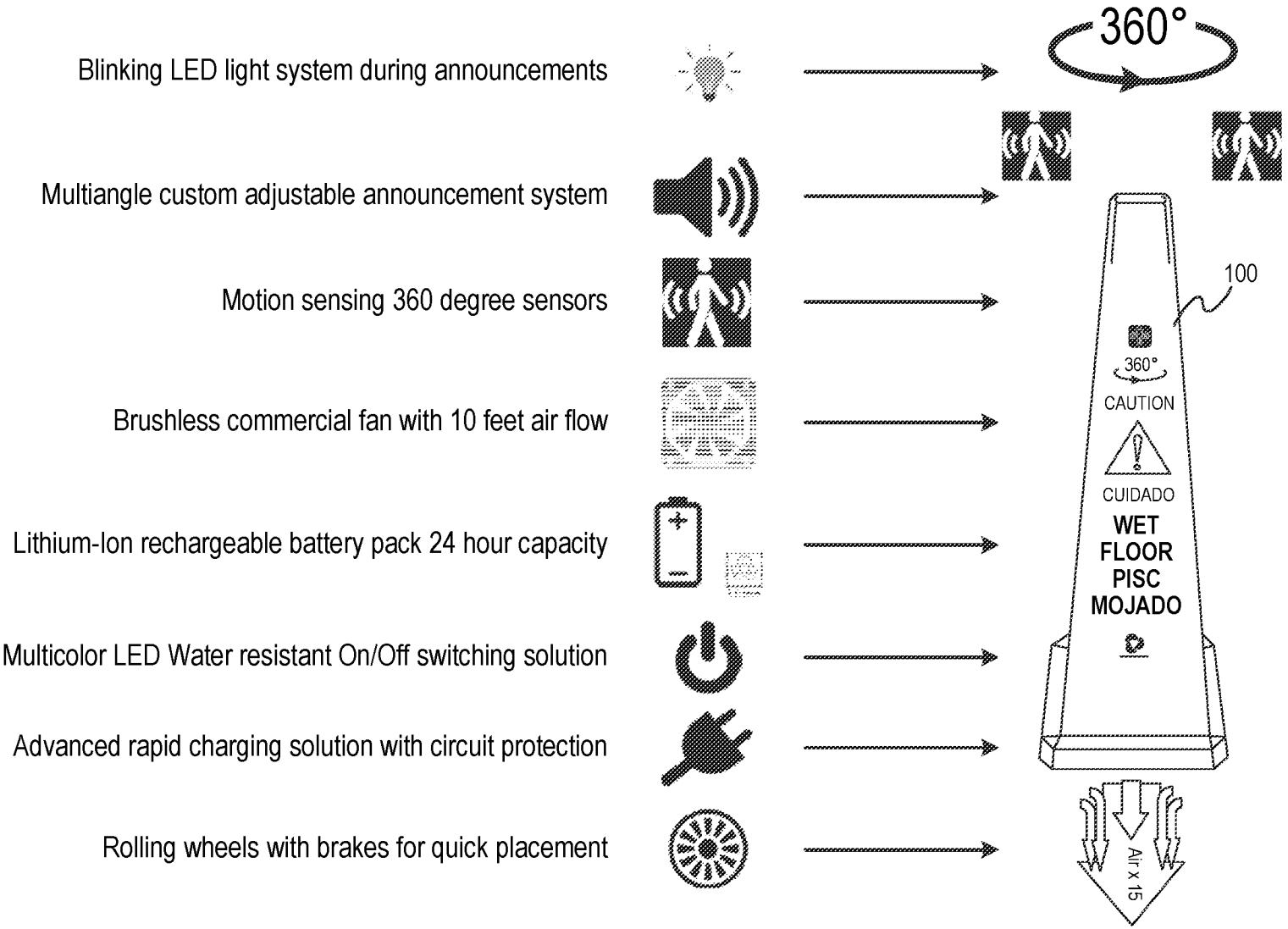
FIG. 2 illustrates some of the features and functions that can be included in the intelligent cone of FIGS. 1A-C.

The intelligent cone 100 can comprise numerous features and functions that not only make it a useful warning that people will pay attention to, but actually provide features and functions that go beyond a simple, recognizable warning. For example, as illustrated in FIG. 2, cone 100 can comprise wheels, instead of at least some of legs 108. In certain embodiments, such legs can be purely mechanical and just allow for the cone 100 to be manually rolled from place to place.

But in other embodiments, any such wheels can be motor driven. This allow for the cone 100 to be controlled remotely, and even allow for self-deployment as described below.

In addition, the cone 100 can comprise light indicators that can blink or light up when someone approaches the cone 100. The lights can for example be LED lights. The cone can also include motion sensors that can detect when someone is approaching the cone, which can then cause the lights to be activated and/or a message to be played via a speaker included, e.g., in compartment(s) 106. The message or announcement can be delivered in multiple languages. The message can comprise a warning, or customer redirection via voice announcement in combination with indicators from the lights.

As can also be seen, the cone 100 can comprise a battery, such as a lithium battery that can be recharged. The cone can also comprise an on-off switch.

In addition, cone 100 can actually include a fan unit that can be used to dry spills on the floor in the area where the cone 100 is deployed. In some such embodiments, the cone can dry floors 360 degrees around unit and up to 10-15 feet in diameter. Base 104 can include, e.g., an advanced 3D printed grill for smooth air flow through the base 104.

The motion sensors can comprise a camera or cameras that can take video or pictures. Alternatively, a camera or cameras can be included but be separate from the motion sensing system of sensors. Cone 100 can also include a microphone. As such, in certain embodiments cone 100 can be configured to record, both visually and audibly events that occur around cone 100. For example, the cone can act as a security camera, with sound recording. Thus, for example, if the cone 100 is deployed in a parking garage or a job site, the camera and microphone can provide security surveillance of the surrounding area. Thus, cone 100 can provide intrusion detection and can broadcast voice warnings and light up to discourage unauthorized intrusions.

But these monitoring capabilities can also record events related to the purpose of the cone 100. For example, if the cone 100 was deployed in a store due to a spill, the video and voice recording can record a slip and fall that occurs in the area, along with location and date. If cone 100 is deployed in a parking garage then the video and voice recording of unauthorized parking with location and date.

It should also be noted that the cone 100 can be used to broadcast emergency announcements in the event of an emergency. The lights can also be activated to indicate an emergency.

The location of cone 100 can be tracked via GPS, GSM (LTE) or other location tracking technology. The location can also be entered manually, or determined automatically based on deployment data. For example, if the cone 100 is self-deployed, then the location of the cone would be known to the overall system. As noted below, cone 100 can comprise various wireless communication capabilities. In such embodiments, location can be determined via triangulation or other techniques related to or based on such wireless capabilities.

Figure 7:
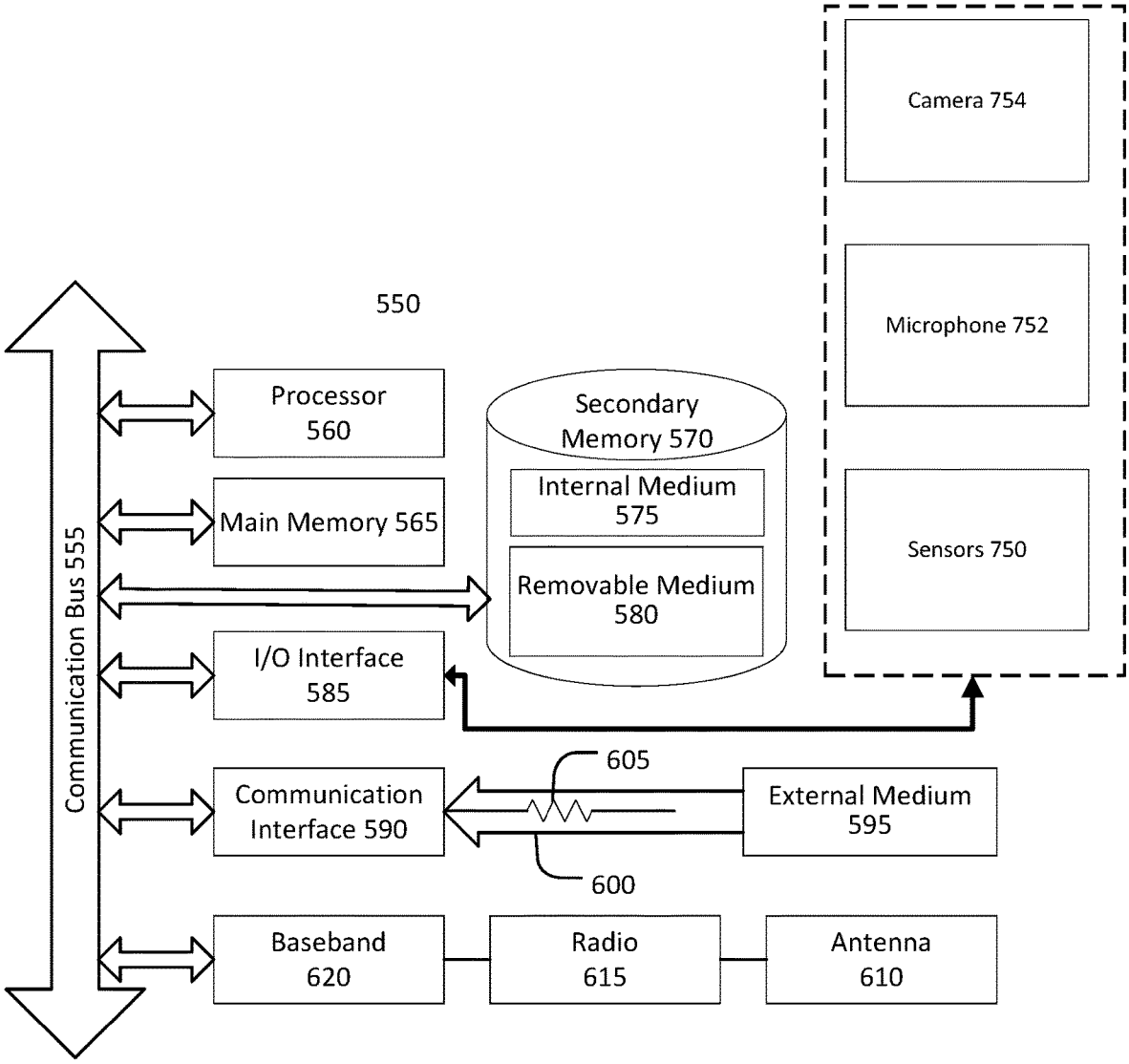
FIG. 7 is a block diagram illustrating an example wired or wireless system that can be used in connection with various embodiments described herein.

Various other sensors can be included in cone 100. For example, sensors can be included that detect rain, sun, humidity, air quality, i.e., the presence of various gases, and even hazardous chemicals. All of this data can be stored along with location information, video, audio, etc. As illustrated in FIG. 7, these sensors 750 can be interfaced through an I/O interface 585, as can a camera 754 and microphone 754.

Cone 100 can also comprise wireless communication capability. This can allow for remote programming of voice, video and data collection. Wireless capability is described below and can be used to transmit video, audio and other data from cone 100 to the backend system. But these technologies can also be used to program cone 100, with messaging and other instructions. Alternatively, or in addition, cone 100 can comprise a hardwire connection such as USB, for programming of cone 100.

In certain embodiments, cone 100 can be configured to generate advertisement announcements while deployed. These announcements can of course be interrupted by emergency or safety announcements. Moreover, cone 100 can record information such as customer walking patters, traffic, product interest, etc. This information can also be communicated to the back end and stored.

Example areas where cone 100 can be used include, e.g.: High Traffic Areas; Entryways, Lobbies, Hallways; Restrooms; Self-Serve Beverage/Food Areas; Dining Areas; Kitchen Areas; Locker Room/Shower Areas; and Factory Floor.

Locations include: Airports; Amusement Parks; Convention Centers; Educational Facilities; Schools, Libraries, Daycare Centers; Food Service, Restaurants; Grocery Stores, Fast Food; HealthCare, Hospitals; Nursing Homes, Doctors Offices; Exercise Facilities; Industrial/Manufacturing Facilities; Lodging Hotels, Motels, Resorts; Office Buildings/Banks; Retail Department Stores, Malls; Gas Stations, Convenience Stores; Entertainment Complexes; Stadiums, Sports Complex, Arenas; and Theaters, Museums.

Figure 3:
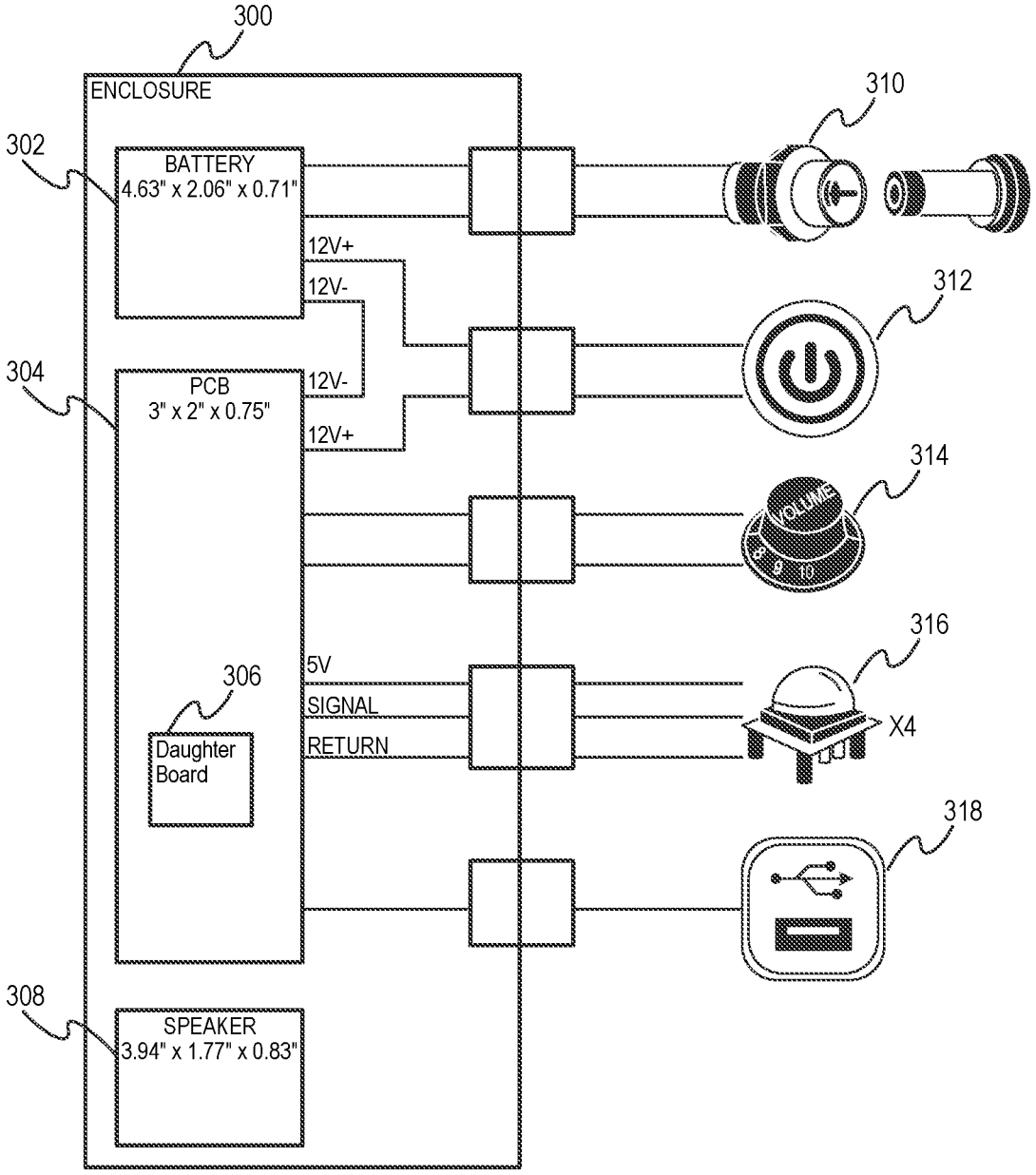
FIG. 3 is a diagram illustrating electrical components that can be included in the intelligent cone of FIGS. 1A-C.

FIG. 3 is a diagram illustrating electronic components including circuit board 304 that can include the circuits that operate cone 100 and provide the functions described above. As can be seen, the circuitry can be included in an enclosure 300, which can for example be part of compartment 106.

As can be seen in FIG. 3, compartment 300 can include a battery 302, which can be interfaced with a connector 310 to allow for charging of the battery. As well as power "button" 312, this can be configured to cause voltage form battery 302 to be provided to circuit board 304.

PCB board 304 can comprise the processing circuits as described with respect to FIG. 7 that are needed to run cone 100 and provide the features and functions described herein. As can be seen, circuit board 304 can be interfaced with a volume controller 314 to control the volume of speaker 308. In other embodiments the volume of speaker 308 can be controlled automatically through hardware or software settings.

Circuit board 304 can also be interfaced with a plurality of, e.g., LEDs 316.

A hardwire, e.g., USB interface can be provided to program circuit board 304 and/or to download information therefrom. Of course as explained, cone 100 can comprise wireless communication capabilities to perform the same functions.

Figure 4A:
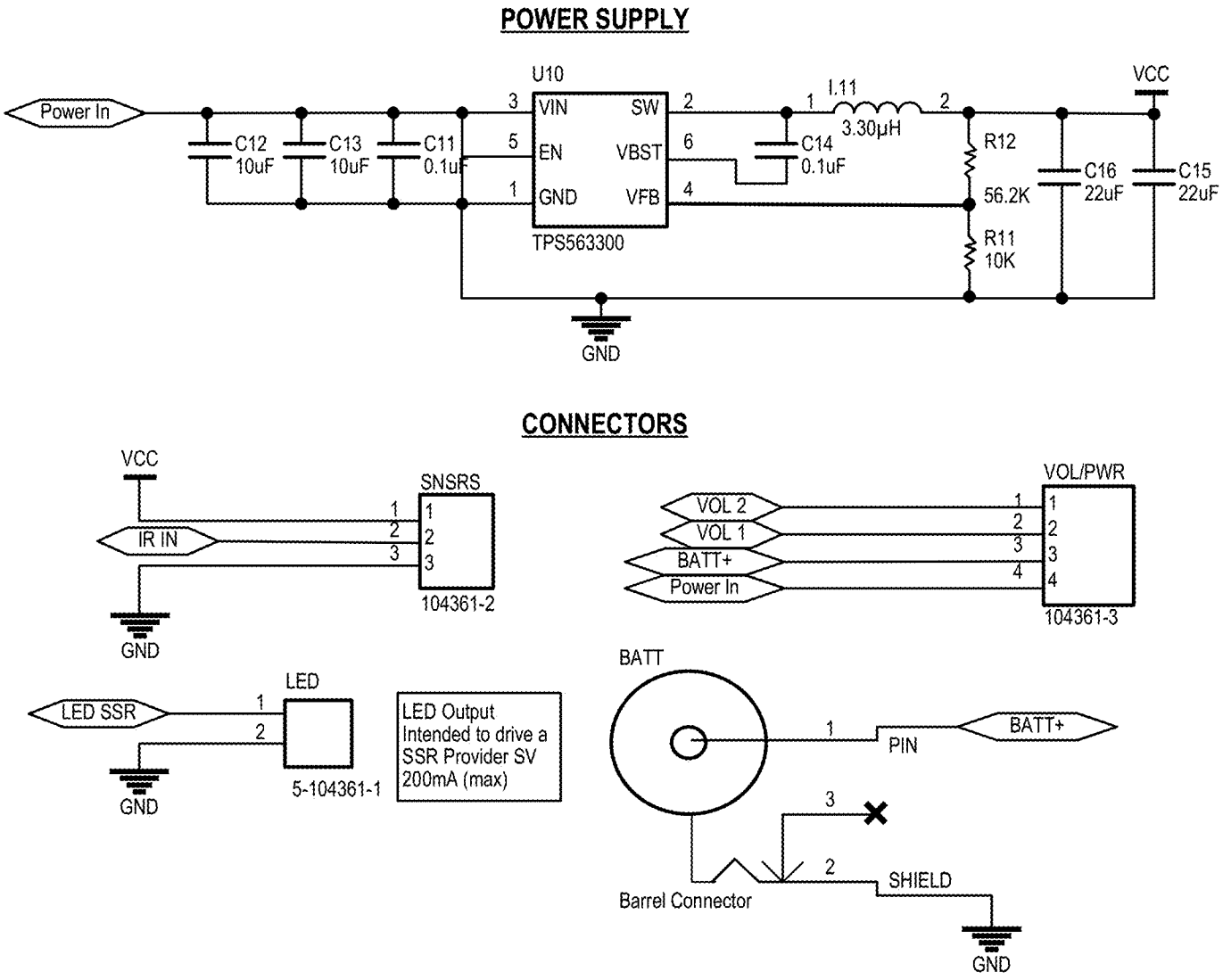
FIGS. 4A and 4B is a schematic illustrating the circuits that can be include in the components of FIG. 3.
Figure 4B:
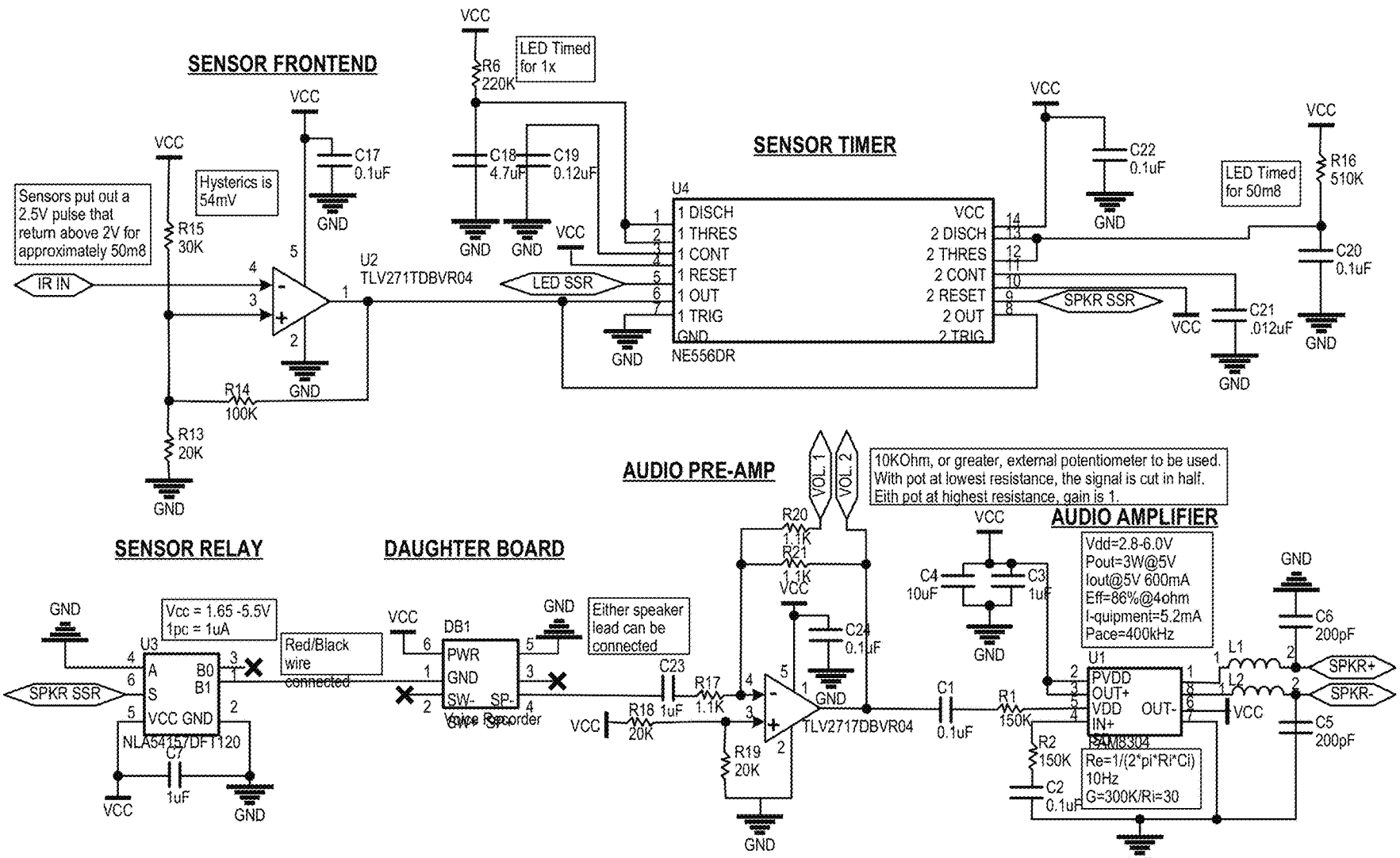

As can be seen circuit board 304 can also comprise a daughter board 306. FIG. 4 is a schematic illustrating some of the circuits that can be included on the circuit board 304 and the daughter board 306 according to one example embodiment.

Figure 8:
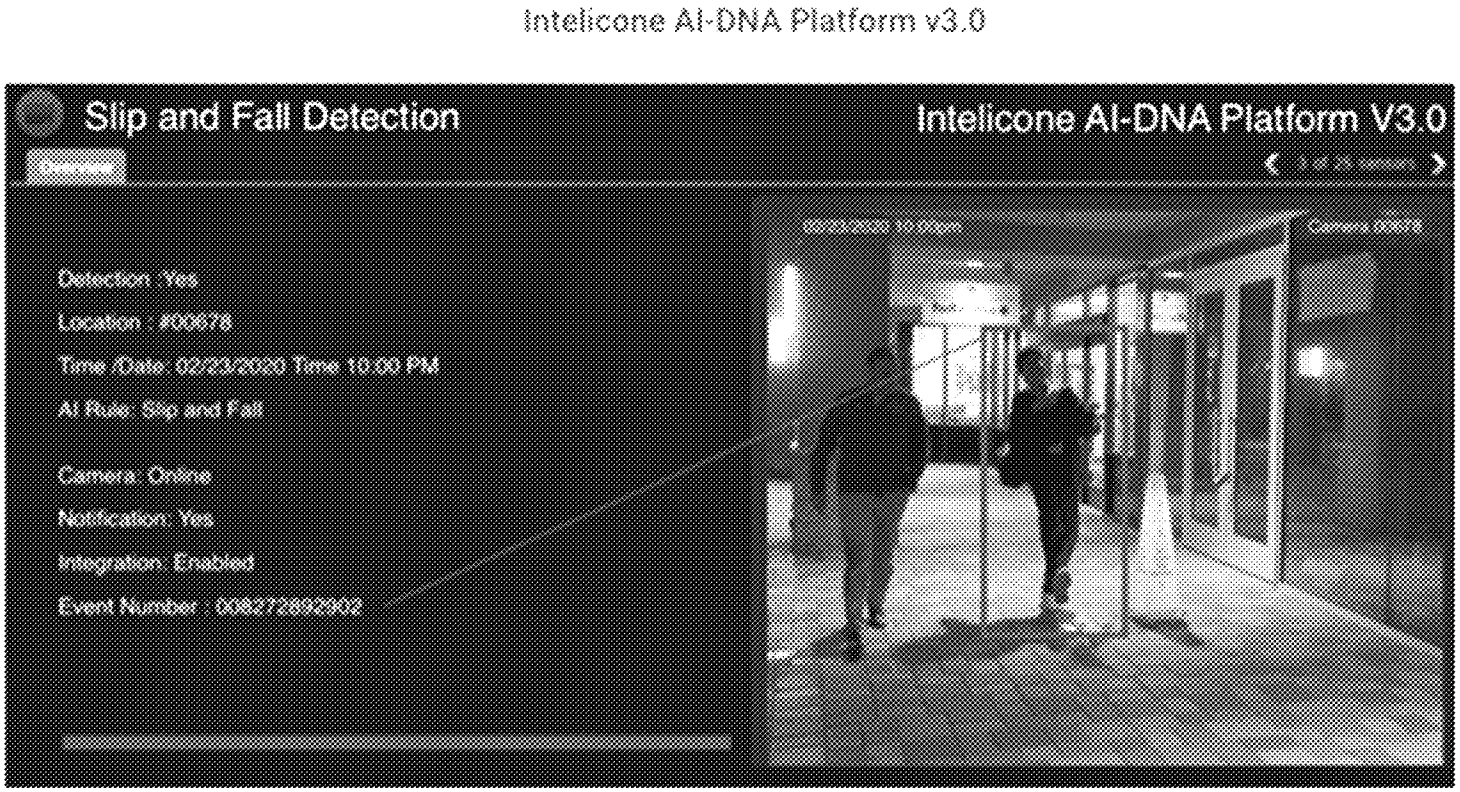
FIG. 8 is a platform is an event information can then be retrieved as illustrated in the screen shot.

As noted above, information related to events can be stored, e.g., in the cloud. Event information can then be retrieved as illustrated in the screen shot of FIG. 8. In certain embodiments, a mobile application can be used to retrieve event data and other information as illustrated in FIG. 9.

Figure 9:
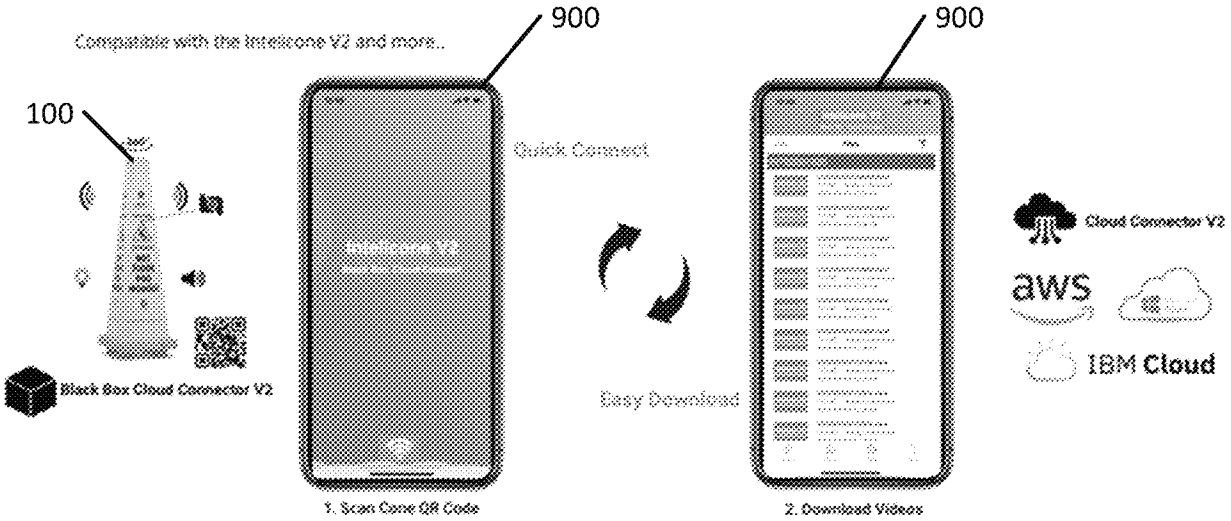
FIG. 9 is a diagram illustrated in certain embodiments, information can be accessed directly from cone 100.

As is also illustrated in FIG. 9, in certain embodiments, information can be accessed directly from cone 100. There are several ways this can be accomplished. For example, cone 100 can have a cable communication port, e.g., a USB port for downloading data collected. Alternatively, cone 100 can have some kind of wireless interface, such as WiFi or Bluetooth, for accessing and/or downloading data from the cone 100.

The information downloaded can be used locally, e.g., on a device 900, or it can as explained be stored remotely, e.g., in the cloud. Cone 100 can include some form of identifier so that information in the cloud is associated with a specific cone. Cone 100 can be interrogated to determine its identifier in order to access information for that cone. In the example of FIG. 9, a QR code is used to identify the cone 100. A user can, e.g., scan the QR code, and then access the information for that cone from the cloud, or remote storage.

Figure 5:
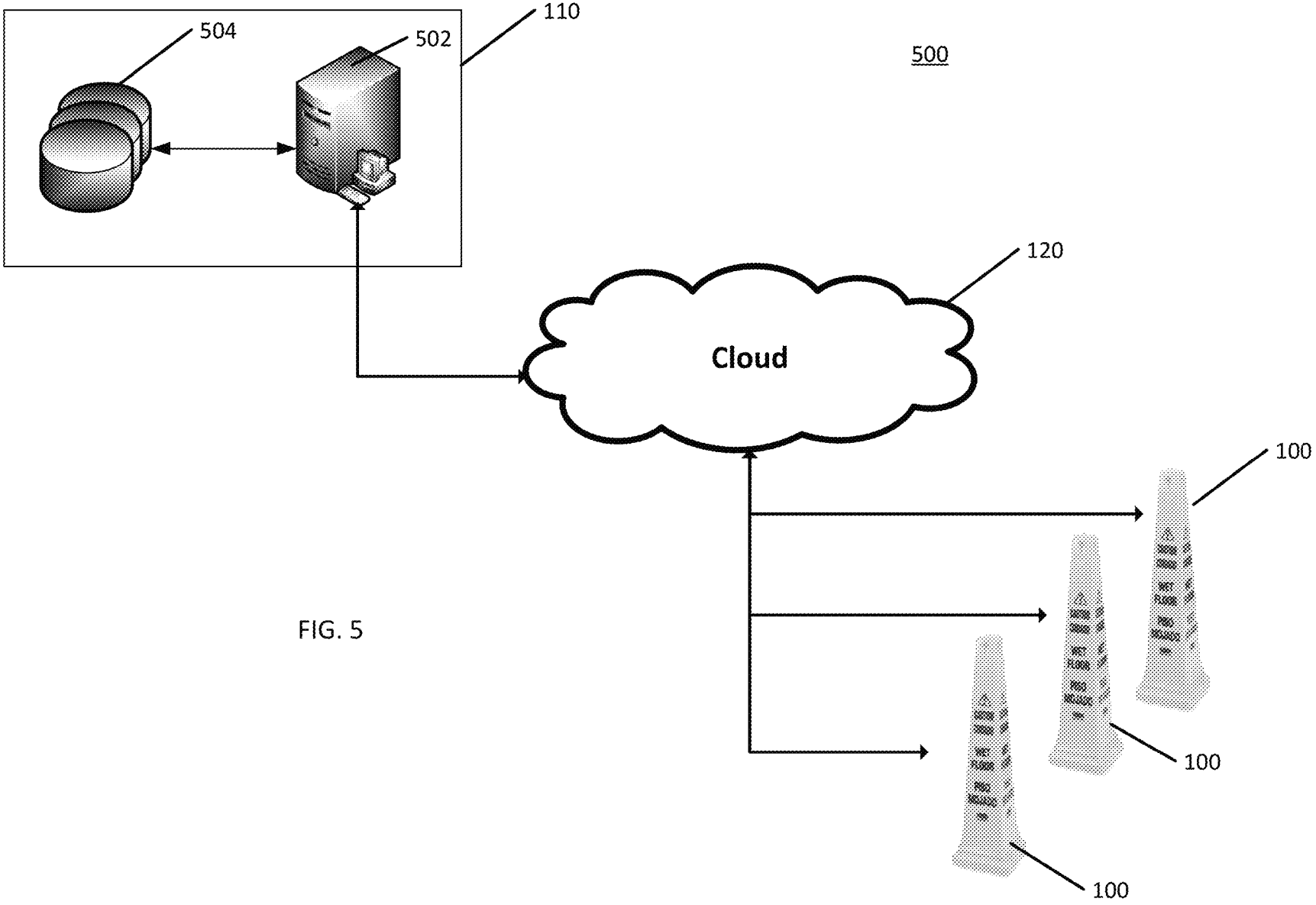
FIG. 5 is a diagram illustrating an intelligent cone system that can include one or more of the intelligent cones of FIG. 1.

FIG. 5 is a diagram illustrating an example system 500 that comprises a platform 110 that can be used to communicate with and control one or more intelligent cones 100. As noted above, cones 100 can have wired or wireless communication capability that can be used to provide instructions to cones 100. Platform 110 can comprise one or more servers 502 interfaced with one or more databases 504. A more detailed description of platform 110 is provided below.

Platform 110 can use the wired or wireless communication capability included in cone(s) 100 to provide updated messages and other information. For example, if cone(s) 100 comprise wheels and automated control, then platform 110 can provide deployment information that can be used by cone(s) 100 to automatically deploy to the proper location.

Moreover, as noted above, the cone(s) 100 can sense and record a lot of information, including video audio, and environmental information including temperature, humidity, levels of certain gases or chemicals, light level, etc. All of this information can be provided to platform 110 and stored in databases(s) 504. The information provided from cone(s) 100 can also be combined with data from other sources, such as security systems, weather databases, etc.

This information can be used to increase safety and security. For example, a moisture sensor included in a cone 100 can provide information that can be used to determine whether a fan included in cone 100 should continue to operate, or whether it can be shut off. The video provided can be used to spot safety issues like new spills, or other potential problems that may require the deployment, or re-deployment of cones 100.

This information can be used for various purposes, beyond just safety and security. For example, customer traffic information deduced from the information provided by the cone(s) 100 can be used to configured store and products layouts and display. But given the amount and types of information that cone(s) 100 can be configured to provide, it is clear that cone(s) can be extremely useful IoT platforms.

As noted above, cone 100 can comprise automated deployment capability that can be managed via platform 110. For example, platform 100 can communicate deployment information, via network 120 to cone(s) 100. As data comes in, e.g., form cone(s) 100 to platform 110, re-deployment data can then be sent to one or more of cone(s) 100.

Thus, for example, if it is known that certain areas become slippery or dangerous when it rains, platform 110 can be made aware of impending rain, e.g., via a weather service, and can deploy one or more of cone(s) 100 ahead of time. One cone 100 could for example be pre-deployed, and when it is determined that it is actually raining, e.g., via a rain sensor in the pre-deployed cone 100, then further cones can be deployed. The video included in the cone**9*s*0 100 can be used to determine where to deploy further cone(s) 100**.

In another example, if a security system detects a possible intrusion or other issue, one or more cones 100 can be deployed to gather further information.

Figure 6:
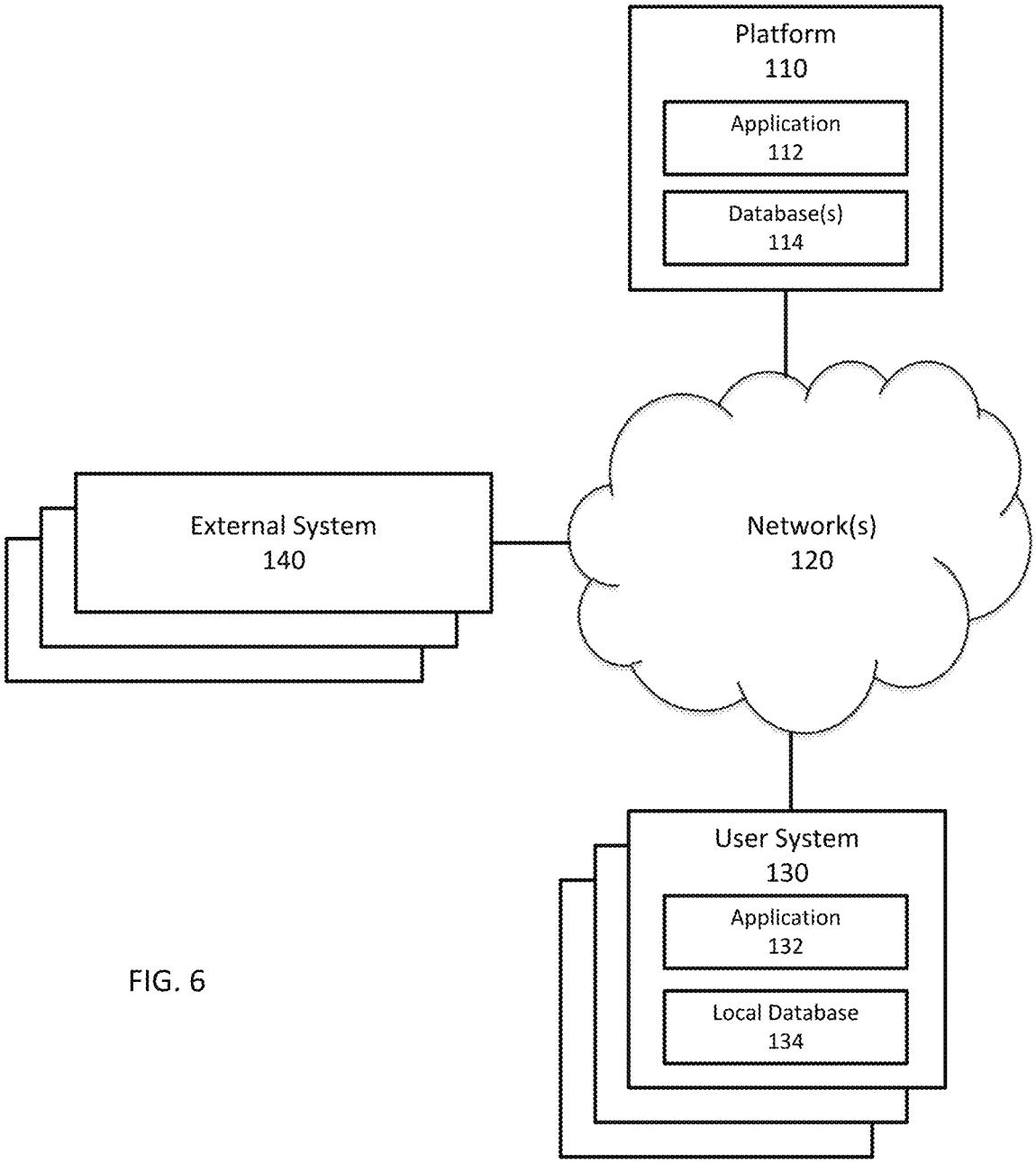
FIG. 6 illustrates an example infrastructure in which one or more of the disclosed processes may be implemented, according to an embodiment.

FIG. 6 illustrates an example infrastructure in which one or more of the disclosed processes may be implemented, according to an embodiment. The infrastructure may comprise a platform 110 (e.g., one or more servers) which hosts and/or executes one or more of the various functions, processes, methods, and/or software modules described herein. Platform 110 may comprise dedicated servers, or may instead comprise cloud instances, which utilize shared resources of one or more servers. These servers or cloud instances may be collocated and/or geographically distributed. Platform 110 may also comprise or be communicatively connected to a server application 112 and/or one or more databases 114. In addition, platform 110 may be communicatively connected to one or more user systems 130 via one or more networks 120. Platform 110 may also be communicatively connected to one or more external systems 140 (e.g., other platforms, websites, etc.) via one or more networks 120.

Network(s) 120 may comprise the Internet, and platform 110 may communicate with user system(s) 130 through the Internet using standard transmission protocols, such as HyperText Transfer Protocol (HTTP), HTTP Secure (HTTPS), File Transfer Protocol (FTP), FTP Secure (FTPS), Secure Shell FTP (SFTP), and the like, as well as proprietary protocols. While platform 110 is illustrated as being connected to various systems through a single set of network(s) 120, it should be understood that platform 110 may be connected to the various systems via different sets of one or more networks. For example, platform 110 may be connected to a subset of user systems 130 and/or external systems 140 via the Internet, but may be connected to one or more other user systems 130 and/or external systems 140 via an intranet. Furthermore, while only a few user systems 130 and external systems 140, one server application 112, and one set of database(s) 114 are illustrated, it should be understood that the infrastructure may comprise any number of user systems, external systems, server applications, and databases.

User system(s) 130 may comprise any type or types of computing devices capable of wired and/or wireless communication, including without limitation, desktop computers, laptop computers, tablet computers, smart phones or other mobile phones, servers, game consoles, televisions, set-top boxes, electronic kiosks, point-of-sale terminals, Automated Teller Machines, and/or the like.

Platform 110 may comprise web servers which host one or more websites and/or web services. In embodiments in which a website is provided, the website may comprise a graphical user interface, including, for example, one or more screens (e.g., webpages) generated in HyperText Markup Language (HTML) or other language. Platform 110 transmits or serves one or more screens of the graphical user interface in response to requests from user system(s) 130. In some embodiments, these screens may be served in the form of a wizard, in which case two or more screens may be served in a sequential manner, and one or more of the sequential screens may depend on an interaction of the user or user system 130 with one or more preceding screens. The requests to platform 110 and the responses from platform 110, including the screens of the graphical user interface, may both be communicated through network(s) 120, which may include the Internet, using standard communication protocols (e.g., HTTP, HTTPS, etc.). These screens (e.g., webpages) may comprise a combination of content and elements, such as text, images, videos, animations, references (e.g., hyperlinks), frames, inputs (e.g., textboxes, text areas, checkboxes, radio buttons, drop-down menus, buttons, forms, etc.), scripts (e.g., JavaScript), and the like, including elements comprising or derived from data stored in one or more databases (e.g., database(s) 114) that are locally and/or remotely accessible to platform 110. Platform 110 may also respond to other requests from user system(s) 130.

Platform 110 may further comprise, be communicatively coupled with, or otherwise have access to one or more database(s) 114. For example, platform 110 may comprise one or more database servers which manage one or more databases 114. A user system 130 or server application 112 executing on platform 110 may submit data (e.g., user data, form data, etc.) to be stored in database(s) 114, and/or request access to data stored in database(s) 114. Any suitable database may be utilized, including without limitation MySQL™, Oracle™ IBM™, Microsoft SQL™, Access™, PostgreSQL™, and the like, including cloud-based databases and proprietary databases. Data may be sent to platform 110, for instance, using the well-known POST request supported by HTTP, via FTP, and/or the like. This data, as well as other requests, may be handled, for example, by server-side web technology, such as a servlet or other software module (e.g., comprised in server application 112), executed by platform 110.

In embodiments in which a web service is provided, platform 110 may receive requests from external system(s) 140, and provide responses in eXtensible Markup Language (XML), JavaScript Object Notation (JSON), and/or any other suitable or desired format. In such embodiments, platform 110 may provide an application programming interface (API) which defines the manner in which user system(s) 130 and/or external system(s) 140 may interact with the web service. Thus, user system(s) 130 and/or external system(s) 140 (which may themselves be servers), can define their own user interfaces, and rely on the web service to implement or otherwise provide the backend processes, methods, functionality, storage, and/or the like, described herein. For example, in such an embodiment, a client application 132 executing on one or more user system(s) 130 may interact with a server application 112 executing on platform 110 to execute one or more or a portion of one or more of the various functions, processes, methods, and/or software modules described herein. Client application 132 may be "thin," in which case processing is primarily carried out server-side by server application 112 on platform 110. A basic example of a thin client application 132 is a browser application, which simply requests, receives, and renders webpages at user system(s) 130, while server application 112 on platform 110 is responsible for generating the webpages and managing database functions. Alternatively, the client application may be "thick," in which case processing is primarily carried out client-side by user system(s) 130. It should be understood that client application 132 may perform an amount of processing, relative to server application 112 on platform 110, at any point along this spectrum between "thin" and "thick," depending on the design goals of the particular implementation. In any case, the application described herein, which may wholly reside on either platform 110 (e.g., in which case server application 112 performs all processing) or user system(s) 130 (e.g., in which case client application 132 performs all processing) or be distributed between platform 110 and user system(s) 130 (e.g., in which case server application 112 and client application 132 both perform processing), can comprise one or more executable software modules that implement one or more of the processes, methods, or functions of the application described herein.

FIG. 7 is a block diagram illustrating an example wired or wireless system 550 that can be used in connection with various embodiments described herein. For example the system 550 can be used as or in conjunction with one or more of the platforms, devices, such as cane 100, or processes described above, and may represent components of device, the corresponding backend server(s), and/or other devices described herein. The system 550 can be a server or any conventional personal computer, or any other processor-enabled device that is capable of wired or wireless data communication. Other computer systems and/or architectures may be also used, as will be clear to those skilled in the art.

The system 550 preferably includes one or more processors, such as processor 560. Additional processors may be provided, such as an auxiliary processor to manage input/output, an auxiliary processor to perform floating point mathematical operations, a special-purpose microprocessor having an architecture suitable for fast execution of signal processing algorithms (e.g., digital signal processor), a slave processor subordinate to the main processing system (e.g., back-end processor), an additional microprocessor or controller for dual or multiple processor systems, or a coprocessor. Such auxiliary processors may be discrete processors or may be integrated with the processor 560. Examples of processors which may be used with system 550 include, without limitation, the Pentium® processor, Core i7® processor, and Xeon® processor, all of which are available from Intel Corporation of Santa Clara, Calif.

The processor 560 is preferably connected to a communication bus 555. The communication bus 555 may include a data channel for facilitating information transfer between storage and other peripheral components of the system 550. The communication bus 555 further may provide a set of signals used for communication with the processor 560, including a data bus, address bus, and control bus (not shown). The communication bus 555 may comprise any standard or non-standard bus architecture such as, for example, bus architectures compliant with industry standard architecture (ISA), extended industry standard architecture (EISA), Micro Channel Architecture (MCA), peripheral component interconnect (PCI) local bus, or standards promulgated by the Institute of Electrical and Electronics Engineers (IEEE) including IEEE 488 general-purpose interface bus (GPIB), IEEE 696/S-100, and the like.

System 550 preferably includes a main memory 565 and may also include a secondary memory 570. The main memory 565 provides storage of instructions and data for programs executing on the processor 560, such as one or more of the functions and/or modules discussed above. It should be understood that programs stored in the memory and executed by processor 560 may be written and/or compiled according to any suitable language, including without limitation C/C++, Java, JavaScript, Pearl, Visual Basic, .NET, and the like. The main memory 565 is typically semiconductor-based memory such as dynamic random access memory (DRAM) and/or static random access memory (SRAM). Other semiconductor-based memory types include, for example, synchronous dynamic random access memory (SDRAM), Rambus dynamic random access memory (RDRAM), ferroelectric random access memory (FRAM), and the like, including read only memory (ROM).

The secondary memory 570 may optionally include an internal memory 575 and/or a removable medium 580, for example a floppy disk drive, a magnetic tape drive, a compact disc (CD) drive, a digital versatile disc (DVD) drive, other optical drive, a flash memory drive, etc. The removable medium 580 is read from and/or written to in a well-known manner. Removable storage medium 580 may be, for example, a floppy disk, magnetic tape, CD, DVD, SD card, etc.

The removable storage medium 580 is a non-transitory computer-readable medium having stored thereon computer executable code (i.e., software) and/or data. The computer software or data stored on the removable storage medium 580 is read into the system 550 for execution by the processor 560.

In alternative embodiments, secondary memory 570 may include other similar means for allowing computer programs or other data or instructions to be loaded into the system 550. Such means may include, for example, an external storage medium 595 and an interface 590. Examples of external storage medium 595 may include an external hard disk drive or an external optical drive, or and external magneto-optical drive.

Other examples of secondary memory 570 may include semiconductor-based memory such as programmable read-only memory (PROM), erasable programmable read-only memory (EPROM), electrically erasable read-only memory (EEPROM), or flash memory (block oriented memory similar to EEPROM). Also included are any other removable storage media 580 and communication interface 590, which allow software and data to be transferred from an external medium 595 to the system 550.

System 550 may include a communication interface 590. The communication interface 590 allows software and data to be transferred between system 550 and external devices (e.g. printers), networks, or information sources. For example, computer software or executable code may be transferred to system 550 from a network server via communication interface 590. Examples of communication interface 590 include a built-in network adapter, network interface card (NIC), Personal Computer Memory Card International Association (PCMCIA) network card, card bus network adapter, wireless network adapter, Universal Serial Bus (USB) network adapter, modem, a network interface card (NIC), a wireless data card, a communications port, an infrared interface, an IEEE 1394 fire-wire, or any other device capable of interfacing system 550 with a network or another computing device.

Communication interface 590 preferably implements industry promulgated protocol standards, such as Ethernet IEEE 802 standards, Fiber Channel, digital subscriber line (DSL), asynchronous digital subscriber line (ADSL), frame relay, asynchronous transfer mode (ATM), integrated digital services network (ISDN), personal communications services (PCS), transmission control protocol/Internet protocol (TCP/IP), serial line Internet protocol/point to point protocol (SLIP/PPP), and so on, but may also implement customized or non-standard interface protocols as well.

Software and data transferred via communication interface 590 are generally in the form of electrical communication signals 605. These signals 605 are preferably provided to communication interface 590 via a communication channel 600. In one embodiment, the communication channel 600 may be a wired or wireless network, or any variety of other communication links. Communication channel 600 carries signals 605 and can be implemented using a variety of wired or wireless communication means including wire or cable, fiber optics, conventional phone line, cellular phone link, wireless data communication link, radio frequency ("RF") link, or infrared link, just to name a few.

Computer executable code (i.e., computer programs or software) is stored in the main memory 565 and/or the secondary memory 570. Computer programs can also be received via communication interface 590 and stored in the main memory 565 and/or the secondary memory 570. Such computer programs, when executed, enable the system 550 to perform the various functions of the present invention as previously described.

In this description, the term "computer readable medium" is used to refer to any non-transitory computer readable storage media used to provide computer executable code (e.g., software and computer programs) to the system 550. Examples of these media include main memory 565, secondary memory 570 (including internal memory 575, removable medium 580, and external storage medium 595), and any peripheral device communicatively coupled with communication interface 590 (including a network information server or other network device). These non-transitory computer readable mediums are means for providing executable code, programming instructions, and software to the system 550.

In an embodiment that is implemented using software, the software may be stored on a computer readable medium and loaded into the system 550 by way of removable medium 580, I/O interface 585, or communication interface 590. In such an embodiment, the software is loaded into the system 550 in the form of electrical communication signals 605. The software, when executed by the processor 560, preferably causes the processor 560 to perform the inventive features and functions previously described herein.

In an embodiment, I/O interface 585 provides an interface between one or more components of system 550 and one or more input and/or output devices. Example input devices include, without limitation, keyboards, touch screens or other touch-sensitive devices, biometric sensing devices, computer mice, trackballs, pen-based pointing devices, and the like. Examples of output devices include, without limitation, cathode ray tubes (CRTs), plasma displays, light-emitting diode (LED) displays, liquid crystal displays (LCDs), printers, vacuum florescent displays (VFDs), surface-conduction electron-emitter displays (SEDs), field emission displays (FEDs), and the like.

The system 550 also includes optional wireless communication components that facilitate wireless communication over a voice and over a data network. The wireless communication components comprise an antenna system 610, a radio system 615 and a baseband system 620. In the system 550, radio frequency (RF) signals are transmitted and received over the air by the antenna system 610 under the management of the radio system 615.

In one embodiment, the antenna system 610 may comprise one or more antennae and one or more multiplexors (not shown) that perform a switching function to provide the antenna system 610 with transmit and receive signal paths. In the receive path, received RF signals can be coupled from a multiplexor to a low noise amplifier (not shown) that amplifies the received RF signal and sends the amplified signal to the radio system 615.

In alternative embodiments, the radio system 615 may comprise one or more radios that are configured to communicate over various frequencies. In one embodiment, the radio system 615 may combine a demodulator (not shown) and modulator (not shown) in one integrated circuit (IC). The demodulator and modulator can also be separate components. In the incoming path, the demodulator strips away the RF carrier signal leaving a baseband receive audio signal, which is sent from the radio system 615 to the baseband system 620.

If the received signal contains audio information, then baseband system 620 decodes the signal and converts it to an analog signal. Then the signal is amplified and sent to a speaker. The baseband system 620 also receives analog audio signals from a microphone. These analog audio signals are converted to digital signals and encoded by the baseband system 620. The baseband system 620 also codes the digital signals for transmission and generates a baseband transmit audio signal that is routed to the modulator portion of the radio system 615. The modulator mixes the baseband transmit audio signal with an RF carrier signal generating an RF transmit signal that is routed to the antenna system and may pass through a power amplifier (not shown). The power amplifier amplifies the RF transmit signal and routes it to the antenna system 610 where the signal is switched to the antenna port for transmission.

The baseband system 620 is also communicatively coupled with the processor 560. The central processing unit 560 has access to data storage areas 565 and 570. The central processing unit 560 is preferably configured to execute instructions (i.e., computer programs or software) that can be stored in the memory 565 or the secondary memory 570.

Computer programs can also be received from the baseband processor 610 and stored in the data storage area 565 or in secondary memory 570, or executed upon receipt. Such computer programs, when executed, enable the system 550 to perform the various functions of the present invention as previously described. For example, data storage areas 565 may include various software modules (not shown).

Various embodiments may also be implemented primarily in hardware using, for example, components such as application specific integrated circuits (ASICs), or field programmable gate arrays (FPGAs). Implementation of a hardware state machine capable of performing the functions described herein will also be apparent to those skilled in the relevant art. Various embodiments may also be implemented using a combination of both hardware and software.

Furthermore, those of skill in the art will appreciate that the various illustrative logical blocks, modules, circuits, and method steps described in connection with the above described figures and the embodiments disclosed herein can often be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled persons can implement the described functionality in varying ways for each particular application, but such implementation decisions should not be interpreted as causing a departure from the scope of the invention. In addition, the grouping of functions within a module, block, circuit or step is for ease of description. Specific functions or steps can be moved from one module, block or circuit to another without departing from the invention.

Moreover, the various illustrative logical blocks, modules, functions, and methods described in connection with the embodiments disclosed herein can be implemented or performed with a general purpose processor, a digital signal processor (DSP), an ASIC, FPGA or other programmable logic device, discrete gate or transistor logic, discrete hardware components, or any combination thereof designed to perform the functions described herein. A general-purpose processor can be a microprocessor, but in the alternative, the processor can be any processor, controller, microcontroller, or state machine. A processor can also be implemented as a combination of computing devices, for example, a combination of a DSP and a microprocessor, a plurality of microprocessors, one or more microprocessors in conjunction with a DSP core, or any other such configuration.

Additionally, the steps of a method or algorithm described in connection with the embodiments disclosed herein can be embodied directly in hardware, in a software module executed by a processor, or in a combination of the two. A software module can reside in RAM memory, flash memory, ROM memory, EPROM memory, EEPROM memory, registers, hard disk, a removable disk, a CD-ROM, or any other form of storage medium including a network storage medium. An exemplary storage medium can be coupled to the processor such the processor can read information from, and write information to, the storage medium. In the alternative, the storage medium can be integral to the processor. The processor and the storage medium can also reside in an ASIC.

Any of the software components described herein may take a variety of forms. For example, a component may be a stand-alone software package, or it may be a software package incorporated as a "tool" in a larger software product. It may be downloadable from a network, for example, a website, as a stand-alone product or as an add-in package for installation in an existing software application. It may also be available as a client-server software application, as a web-enabled software application, and/or as a mobile application.

While certain embodiments have been described above, it will be understood that the embodiments described are by way of example only. Accordingly, the systems and methods described herein should not be limited based on the described embodiments. Rather, the systems and methods described herein should only be limited in light of the claims that follow when taken in conjunction with the above description and accompanying drawings.

What is claimed:

1. An intelligent cone comprising:

a base;

a cone section;

at least one light;

a 360 degree motion sensing system;

a fan; and at least one hardware processor; and one or more software modules that are configured to, when executed by the at least one hardware processor, receive information from the sensing system indicating that a person is approaching the intelligent cone, activate the at least one light as a warning to the approaching person, and operate the fan to dry a spill or moisture that is creating a safety issue.

2. The intelligent cone of claim 1, further comprising a speaker, and memory configured to store one or more messages, and wherein the software modules are further configured to, when executed by the at least one hardware processor, cause an announcement to be delivered when information from the sensing system is received indicating that a person is approaching the intelligent cone.

3. The intelligent cone of claim 1, further comprising a battery.

4. The intelligent cone of claim 1, the fan is configured to dry floors 360 degrees around the intelligent cone and up to 10-15 feet in diameter.

5. The intelligent cone of claim 1, wherein the base includes a grill for smooth air flow from the fan through the base.

6. The intelligent cone of claim 1, further comprising a camera or cameras that can take video or pictures.

7. The intelligent cone of claim 6, wherein the camera or cameras are part of the motion sensing system.

8. The intelligent cone of claim 6, wherein the camera or cameras can be configured to record video or images.

9. The intelligent cone of claim 1, further comprising a microphone, and wherein the microphone is configured to record audio.

10. The intelligent cone of claim 1, further comprising GPS or other location tracking technology.

11. The intelligent cones of claim 1, further comprising one or more sensors configured to detect rain, moisture, sun, humidity, air quality, the presence of various gases, and hazardous chemicals.

12. The intelligent cones of claim 1, further comprising wireless communication capability.

13. The intelligent cones of claim 12, wherein the software modules are further configured to, when executed by the at least one hardware processor, receive remote programming of voice, video and data collection.

14. The intelligent cone of claim 12, wherein the software modules are further configured to, when executed by the at least one hardware processor, transmit video, audio and other data from the intelligent cone to a backend system.

* * * * *